US011185458B2

(12) United States Patent
Gabriel

(10) Patent No.: US 11,185,458 B2
(45) Date of Patent: Nov. 30, 2021

(54) STANDING ADJUSTABLE LUMBAR TECHNOLOGY SYSTEM, DEVICE, AND METHOD

(71) Applicant: Dan Gabriel, Jupiter, FL (US)

(72) Inventor: Dan Gabriel, Jupiter, FL (US)

( * ) Notice: Subject to any disclaimer, the term of this patent is extended or adjusted under 35 U.S.C. 154(b) by 389 days.

(21) Appl. No.: 16/293,976

(22) Filed: Mar. 6, 2019

(65) Prior Publication Data

US 2019/0274909 A1 Sep. 12, 2019

Related U.S. Application Data

(60) Provisional application No. 62/639,091, filed on Mar. 6, 2018.

(51) Int. Cl.
*A61H 1/02* (2006.01)
*A61H 3/00* (2006.01)

(52) U.S. Cl.
CPC ..... *A61H 1/0218* (2013.01); *A61H 3/008* (2013.01); *A61H 2203/0406* (2013.01); *A61H 2205/081* (2013.01)

(58) Field of Classification Search
CPC ..... A61H 1/0292; A61H 1/0222; A61H 2201/1607; A61H 2201/1621; A61H 2201/163; A61H 2201/1642; A61H 2203/0456; A61H 2201/1246; A61H 2201/1652; A61H 2203/0493; A61H 2205/081; A61H 1/0244; A61H 2201/1628; A61H 2203/0487; A61H 11/00; A61H 1/0237; A61H 1/0218; A61H 3/008; A61H 2203/0406; A63B 21/0552; A63B 21/0557; A63B 21/4009; A63B 21/4011; A63B 21/4015; A63B 21/00043; A63B 21/02; A63B 23/0405; A63B 21/4039; A63B 2023/006; A63B 21/0023; A63B 2220/51; A63B 23/04; A63B 69/0059; A63B 21/068; A63B 2208/0204; A63B 21/065; A63B 23/035; A63B 2023/003
See application file for complete search history.

(56) References Cited

U.S. PATENT DOCUMENTS 4,030,489 A * 6/1977 Buckner ..... A61H 1/0218 602/5
5,178,596 A * 1/1993 McIntire ..... A63B 21/0552 482/122
5,407,422 A * 4/1995 Matthijs ..... A61F 5/0193 128/876
6,244,995 B1 * 6/2001 Prsala ..... A63B 21/068 482/101
6,648,844 B2 * 11/2003 Kamerman ..... A61H 1/0218 602/32
7,104,935 B2 * 9/2006 Matsuoka ..... A63B 21/0004 482/121

* cited by examiner

*Primary Examiner* — Ophelia A Hawthorne
(74) *Attorney, Agent, or Firm* — McHale & Slavin, P.A.

(57) ABSTRACT

A system or device, and methods of use thereof, for use with one or more regions of the human body, particularly the lumbar region. The standing adjustment lumbar system comprises a lumbar support member, an adjustable tension member, and a platform member.

20 Claims, 19 Drawing Sheets

STANDING ADJUSTABLE LUMBAR TECHNOLOGY SYSTEM, DEVICE, AND METHOD

REFERENCE TO RELATED APPLICATIONS

In accordance with 37 C.F.R 1.76, a claim of priority is included in an Application Data Sheet filed concurrently herewith. Accordingly, the present application claims priority to U.S. Provisional Patent Application No. 62/639,091, filed on Mar. 6, 2018, entitled, "STANDING ADJUSTABLE LUMBAR TECHNOLOGY SYSTEM, DEVICE, AND METHOD". The contents of the above referenced application are herein incorporated by reference in its entirety.

FIELD OF THE INVENTION

The present invention relates to a system or device for use with one or more regions of the human body; to a system or device using a support belt configured to provide continuous and adjustable force while in a standing position for use with the lumbar region of the human body.

BACKGROUND OF THE INVENTION

Back pain is a common ailment. Whether from age, injury, or defective anatomy, pain in the lower extremity affects many people. Often, acute low-back pain is the result of simple strain and is a self-limiting condition, resolving in several weeks, with or without treatment. For those that have more severe, chronic issues, back pain can be difficult to endure, effecting quality of life. While strategies exist to address the pain associated with back pain, ranging from rest, pain medication, and even surgery in the worst of cases, there remains a need for additional means to help those patients that suffer, either acutely or chronically, from such pain.

The present invention addresses the need by providing a system, device, and method using a support belt configured to provide continuous and adjustable force while in a standing position to the lumbar region of the human body.

SUMMARY OF THE INVENTION

The present invention relates to a system, device, and method using a lumbar support belt configured to provide continuous and adjustable force while in a standing position for use with the lumbar region of the human body. The system, device, and method comprise a lumbar support member, an adjustable tension member, and a platform member, and are configured to provide continuous and adjustable forces while the user is in a standing position. The system, device, and method may provide the benefits of alleviating various types of back pain, improving lower extremity strength, balance, position sense and proprioception, and facilitating improved posture and posture awareness.

Accordingly, it is an objective of the invention to provide a standing adjustable lumbar system for use with a person.

It is a further objective of the invention to provide a standing adjustable lumbar system for use with a person which may alleviate lower extremity pain.

It is yet another objective of the invention to provide a standing adjustable lumbar system for use with a person which may improve lower extremity strength.

It is a still further objective of the invention to provide a standing adjustable lumbar system for use with a person which may improve lower extremity balance.

It is a further objective of the invention to provide a standing adjustable lumbar system for use with a person which may improve lower extremity position sense.

It is yet another objective of the invention to provide a standing adjustable lumbar system for use with a person which may improve lower extremity proprioception.

It is a still further objective of the invention to provide a standing adjustable lumbar system for use with a person which may facilitate improved posture and posture awareness.

It is a further objective of the invention to provide a standing adjustable lumbar method which may alleviate or minimize back pain.

It is yet another objective of the invention to provide a standing adjustable lumbar method which may improve lower extremity strength, balance, position sense and proprioception.

It is a still further objective of the invention to provide a standing adjustable lumbar method which may improve posture and posture awareness.

It is a further objective of the invention to provide a standing adjustable lumbar method which may provide isometric contraction of the lower extremities.

It is yet another objective of the invention to provide a standing adjustable lumbar method which may provide isometric contraction of the pelvic girdle muscles.

It is a still further objective of the invention to provide a standing adjustable lumbar method which may provide isometric contraction of lumbar spine musculature.

It is a further objective of the invention to provide a standing adjustable lumbar method which may provide for stretching muscles which affect the spine and posture.

It is yet another objective of the invention to provide a standing adjustable lumbar method which may release tight lumbar/pelvic muscle via fatigue, forcing muscle relaxation and stretching.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1A:
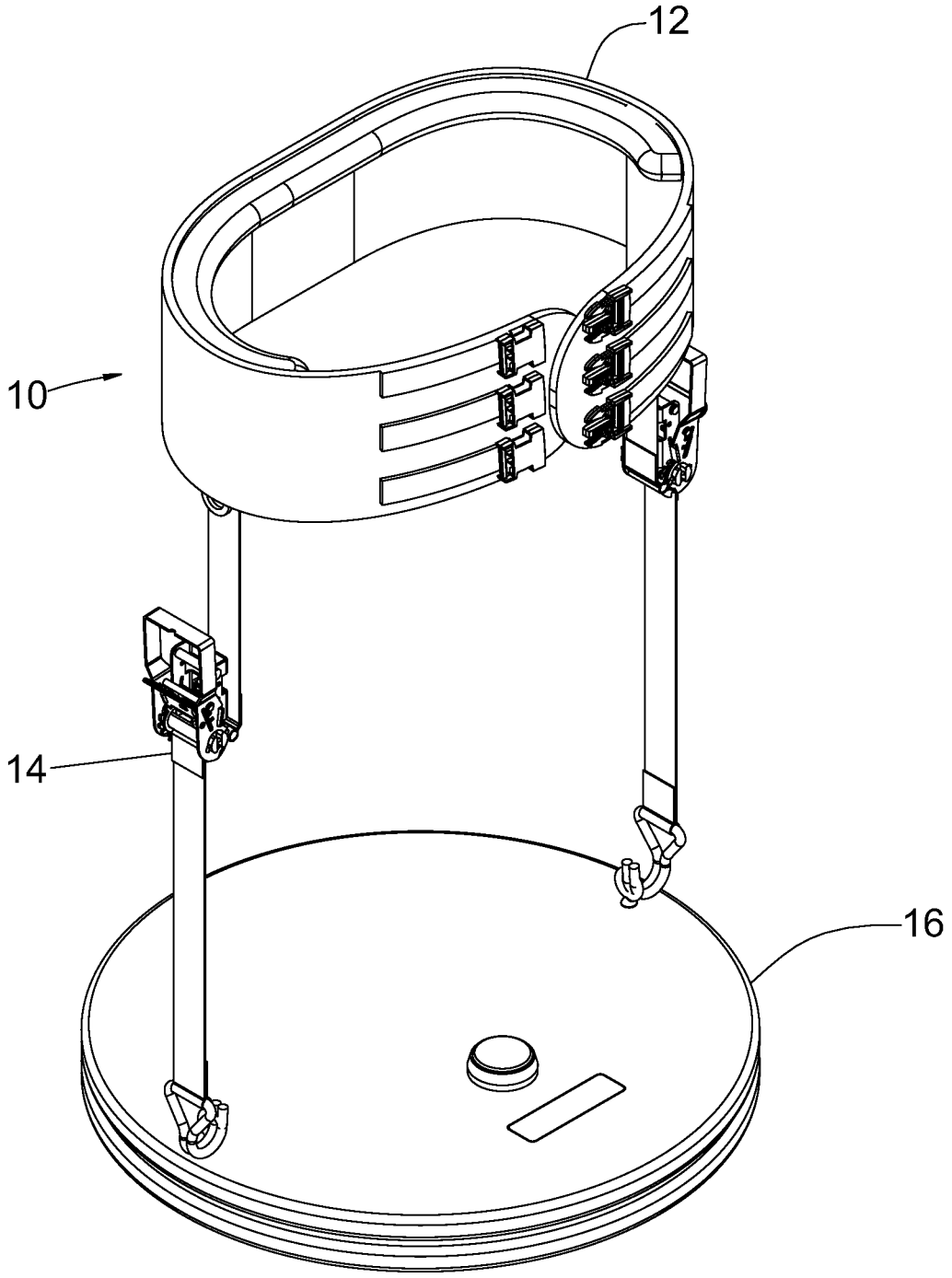
FIG. 1A is a perspective view of an illustrative embodiment of a standing adjustment lumbar system for use with the human body.
Figure 1B:
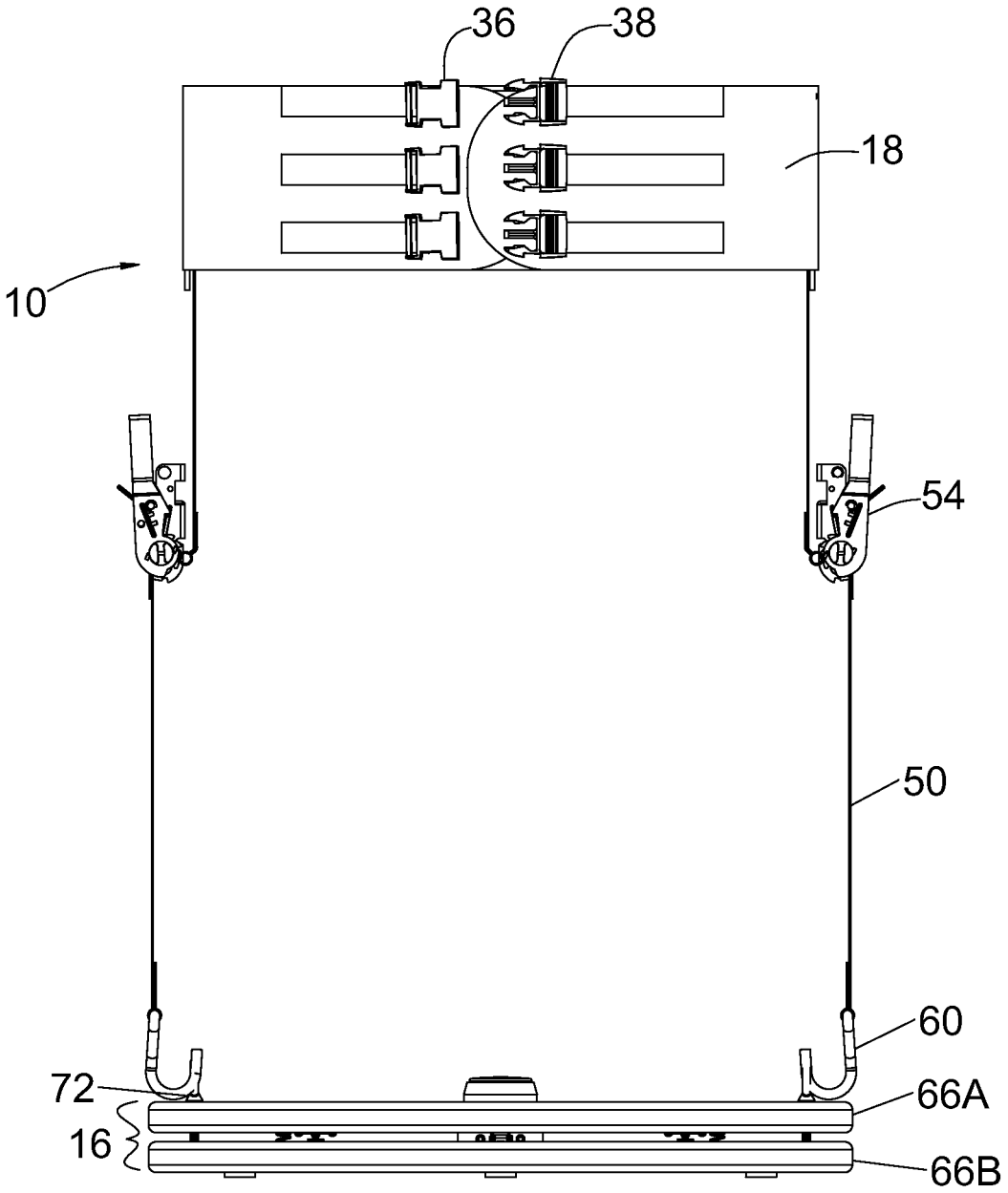
FIG. 1B is a front view of the standing adjustment lumbar system.
Figure 1C:
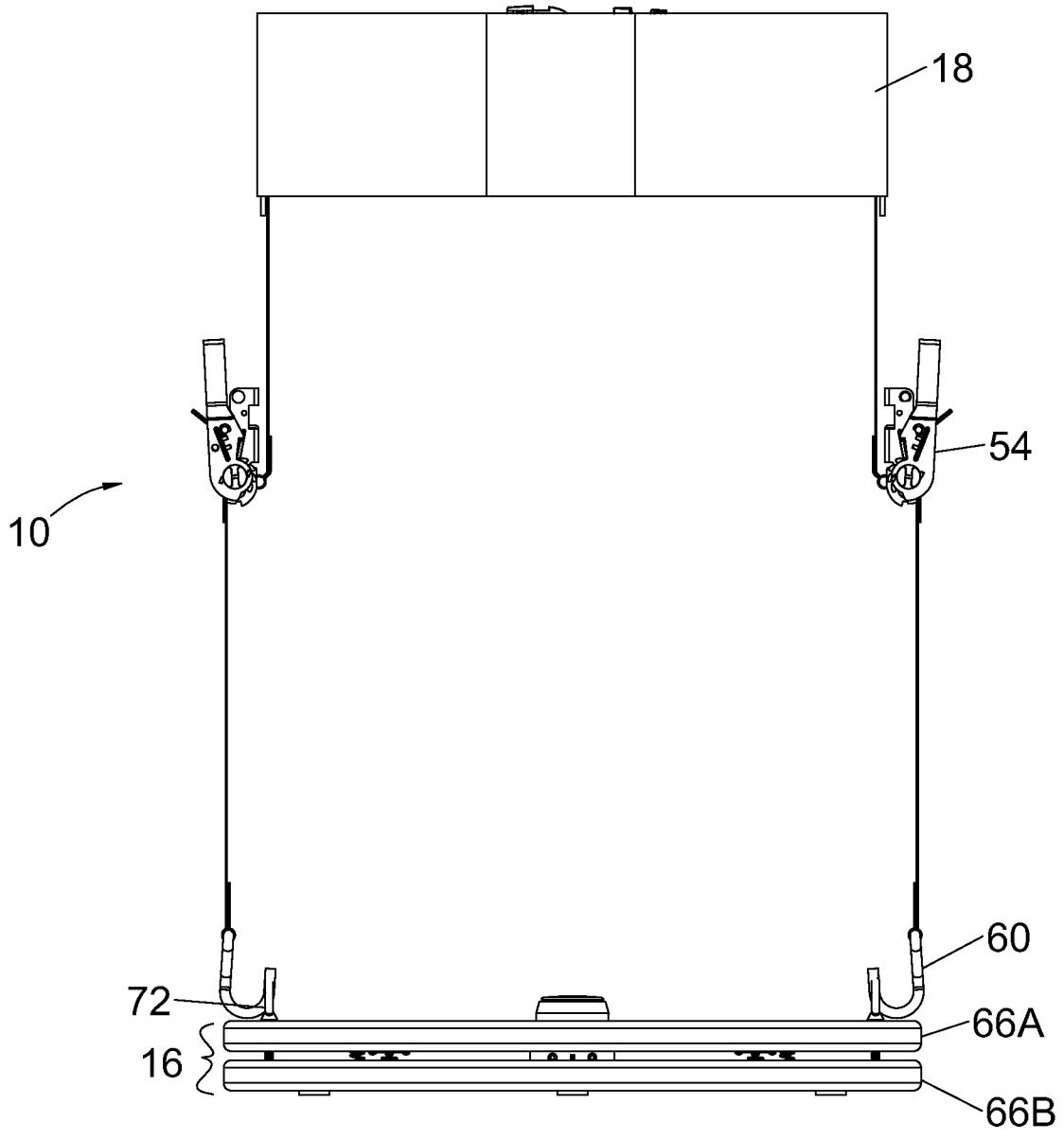
FIG. 1C is a back view of the standing adjustment lumbar system.
Figure 1D:
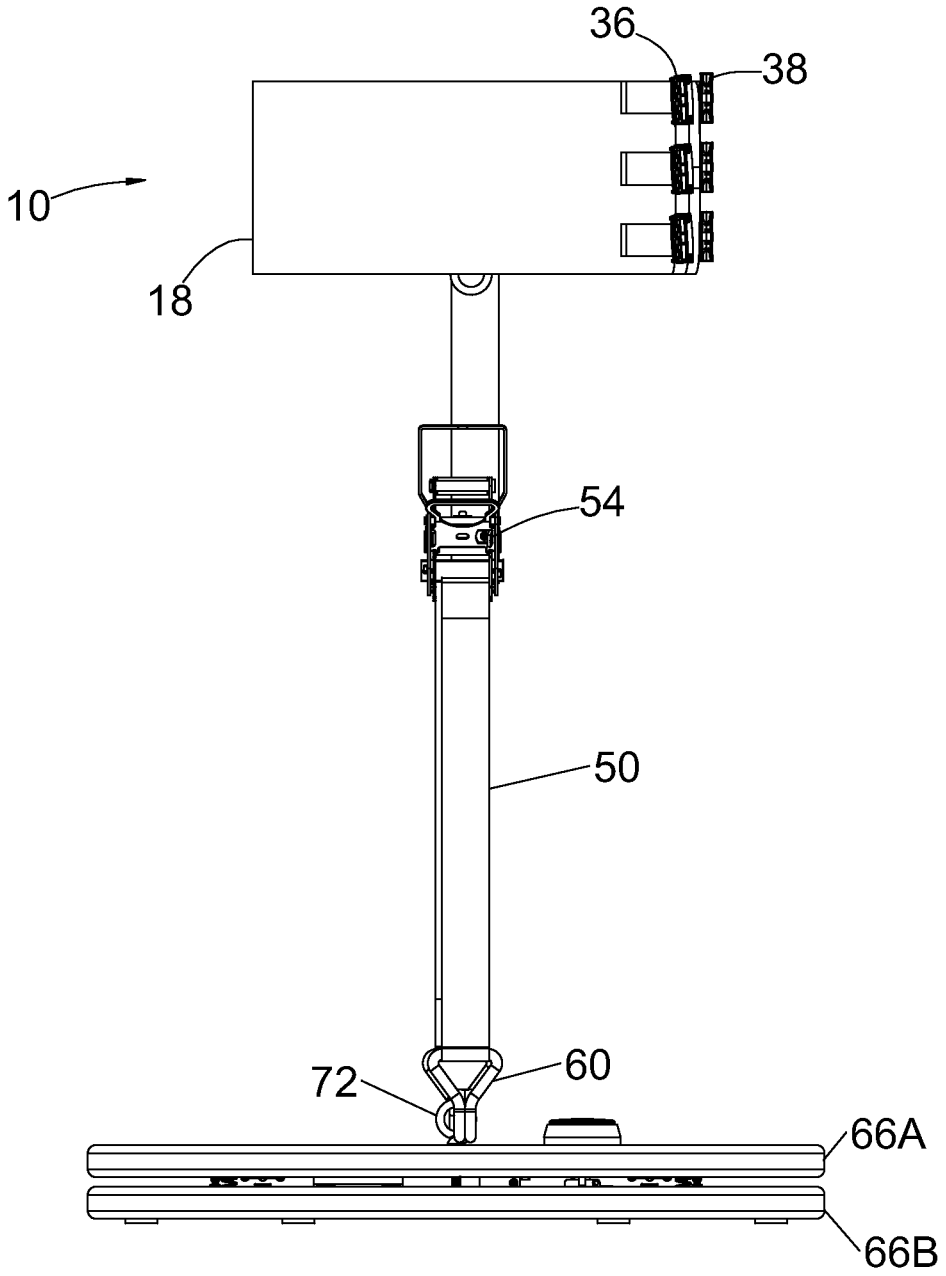
FIG. 1D is a right-side view of the standing adjustment lumbar system.
Figure 1E:
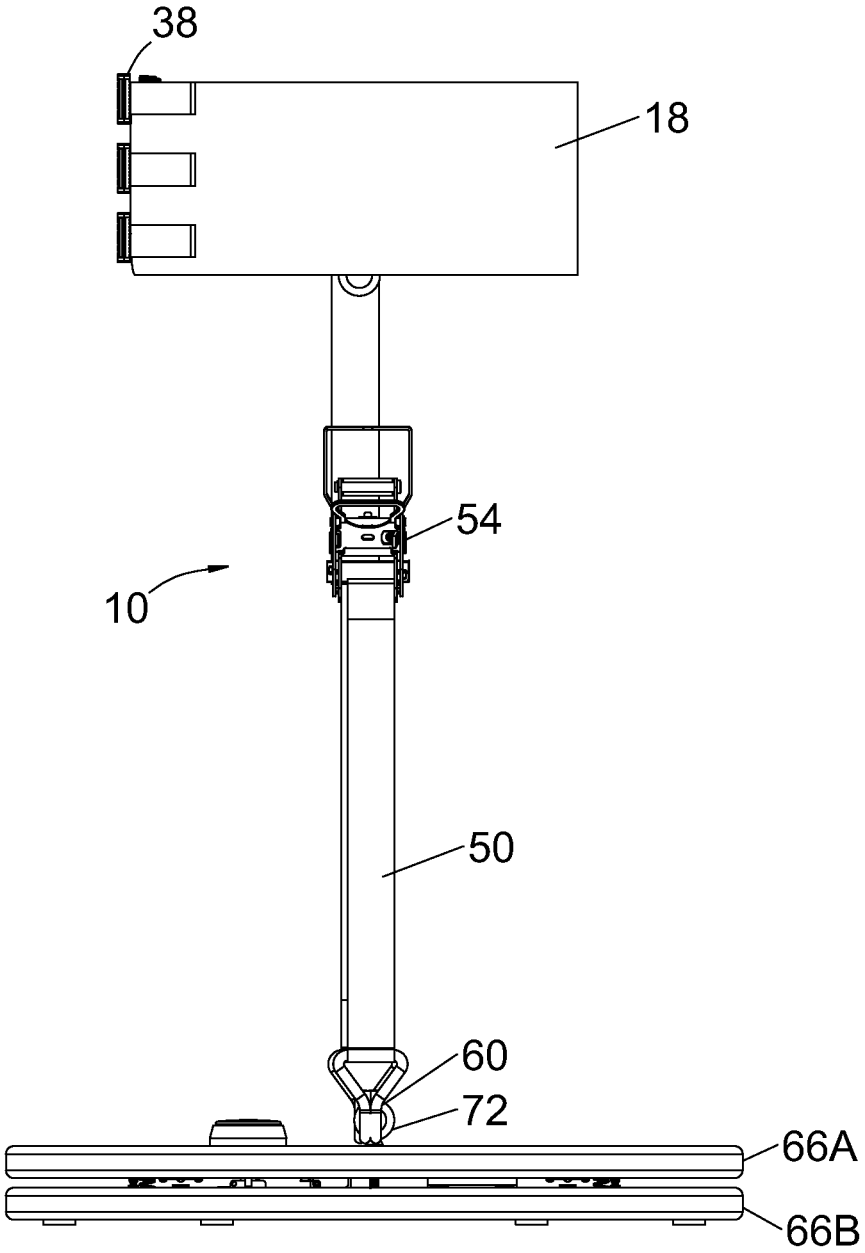
FIG. 1E is a left-side view of the standing adjustment lumbar system.
Figure 1F:
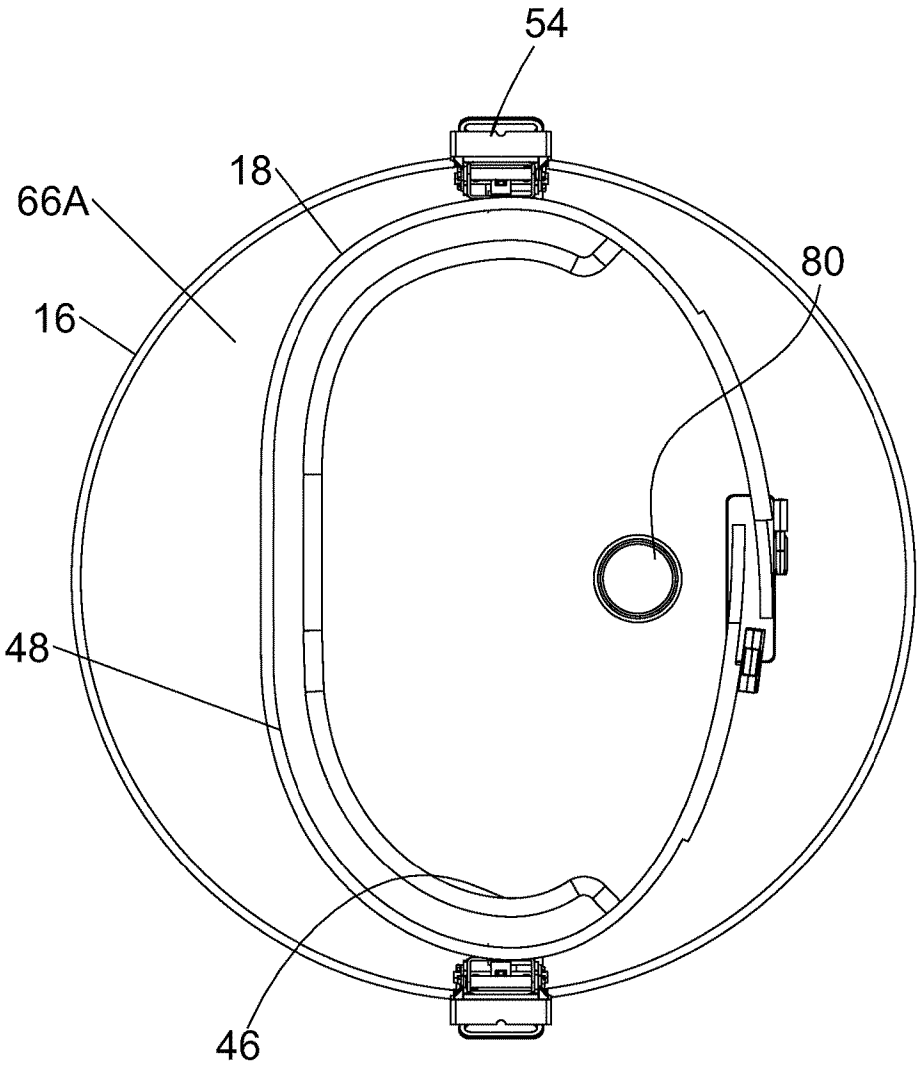
FIG. 1F is a top view of the standing adjustment lumbar system.
Figure 1G:
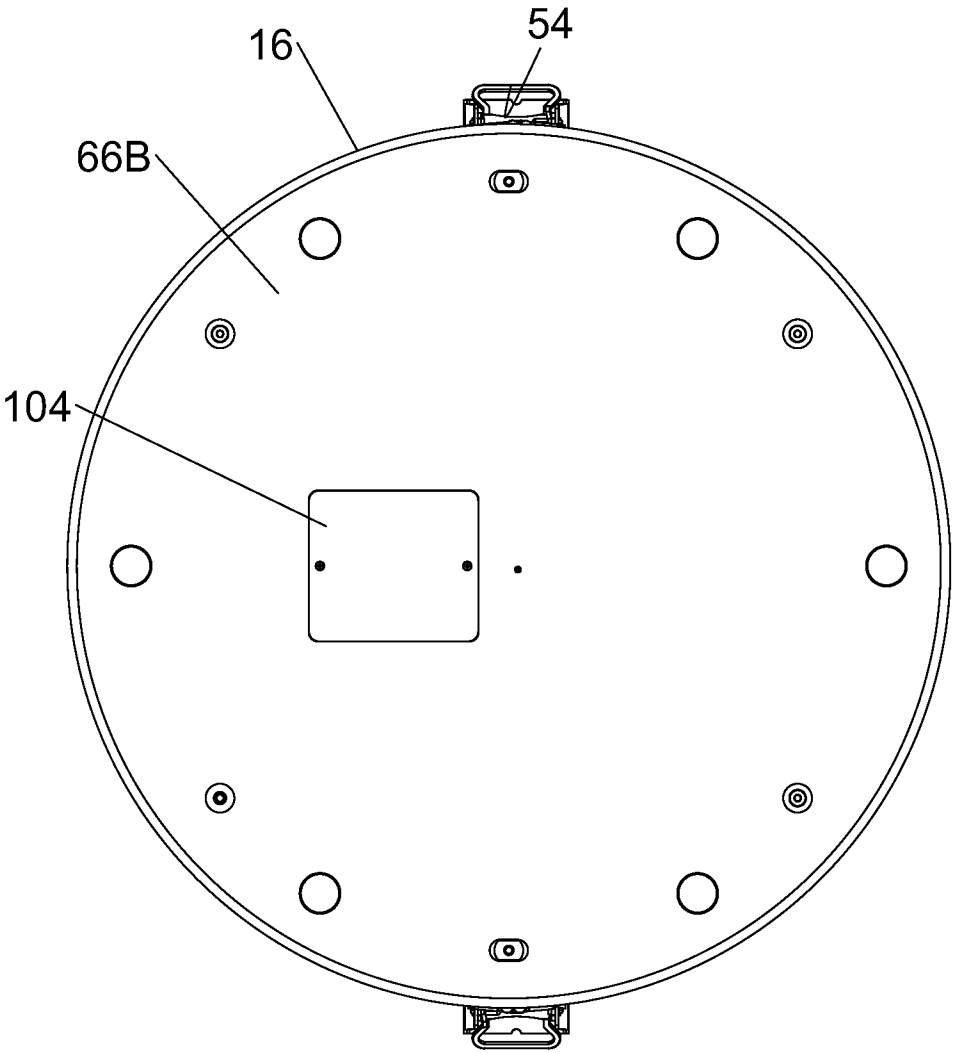
FIG. 1G is a bottom view of the standing adjustment lumbar system.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1A-1G, a system or device for use with one or more regions of the human body, particularly the lumbar region, referred to generally as a standing adjustment lumbar system (may also be referred to as a standing adjustment lumbar device) 10, is illustrated. The standing adjustment lumbar system 10 comprises a lumbar support member 12, an adjustable tension member 14, and a platform member 16. Figure illustrates an embodiment of the lumbar support member 12, shown as a lumbar support belt 18. The lumbar support belt 18 is sized and shaped to secure about at least a portion of a person, preferably around a person's waist, when in use. The lumbar support belt 18 is shown having a first end 20, a second opposing end 22, and an elongated main body 24 therebetween. The lumbar support belt 18 comprises an outer surface 26, defined as the surface not in contact with the person when in use, and an inner surface 28, defined as the surface in contact with the person when in use. The elongated main body 24, and therefore, the lumbar support belt 18, may be made of a cloth material. To prevent slipping, the entire lumbar support belt may be made of a non-slip material, such as a neoprene material. Alternatively, the lumbar support belt 18 may be made of mixed materials. In an illustrative embodiment, at least a portion of the inner surface 28 of the lumbar support belt 18 may be made of a cloth or mesh material, or a non-slip material such as neoprene, or have a portion of the non-slip material attached directly to or on top of the cloth material.

To be securable to a person, the lumbar support belt may utilize a quick release buckle clip, 34, comprising a female buckle latch receiving receptacle 36 and a one pin male buckle latch 38. Attached, via stitching, to the second end 22 of the lumbar support belt 18 are one or more straps 42, each having a female receiving receptacle 36. Other attaching mechanisms known to the one of skill in the art, such as the use of chemical substances, i.e. glue, can be used. Attached to the first end 20 of the lumbar support belt 18 are one or more straps 44, each having a one pin male buckle latch 38. Other securing members known to one of skill in the art may be used as well, including use of VELCRO, i.e. loop and hook securing materials, snaps, buttons, or even zippers.

To aid in maintaining position of the lumbar support belt 18 in place, i.e. secured to or secured around the waist of the individual using the standing adjustment lumbar system 10, the main body 24 of the lumbar support belt 18 may contain a tubular shaped foam material 46 integrally formed or attached to the inner surface 28 near the top portion 48 of the main body 24. The tubular shaped foam material 46 is preferably sized to run a sufficient length of the belt 18 so that, when the belt 18 is placed on a user, the tubular shaped foam material 46 contacts or engages the user's iliac crest, thereby preventing slippage. Alternatively, the belt 18 may contain a sleeve at the top portion 48 of the main body 24, sized and shaped to receive and hold the tubular shaped foam material 46. If used, the sleeve would preferably be placed on each side of the lumbar support belt 18. The sleeve and the tubular shaped foam material 46 therein would also provide a mechanism for allowing the lumbar support belt 18 to contact or grip onto the iliac crests of the user, thereby preventing slippage. Alternatively, a portion of the top portion 48 of the main body 24 may be made to a thicker depth or size relative to the rest of the main body portion.

Figure 2:
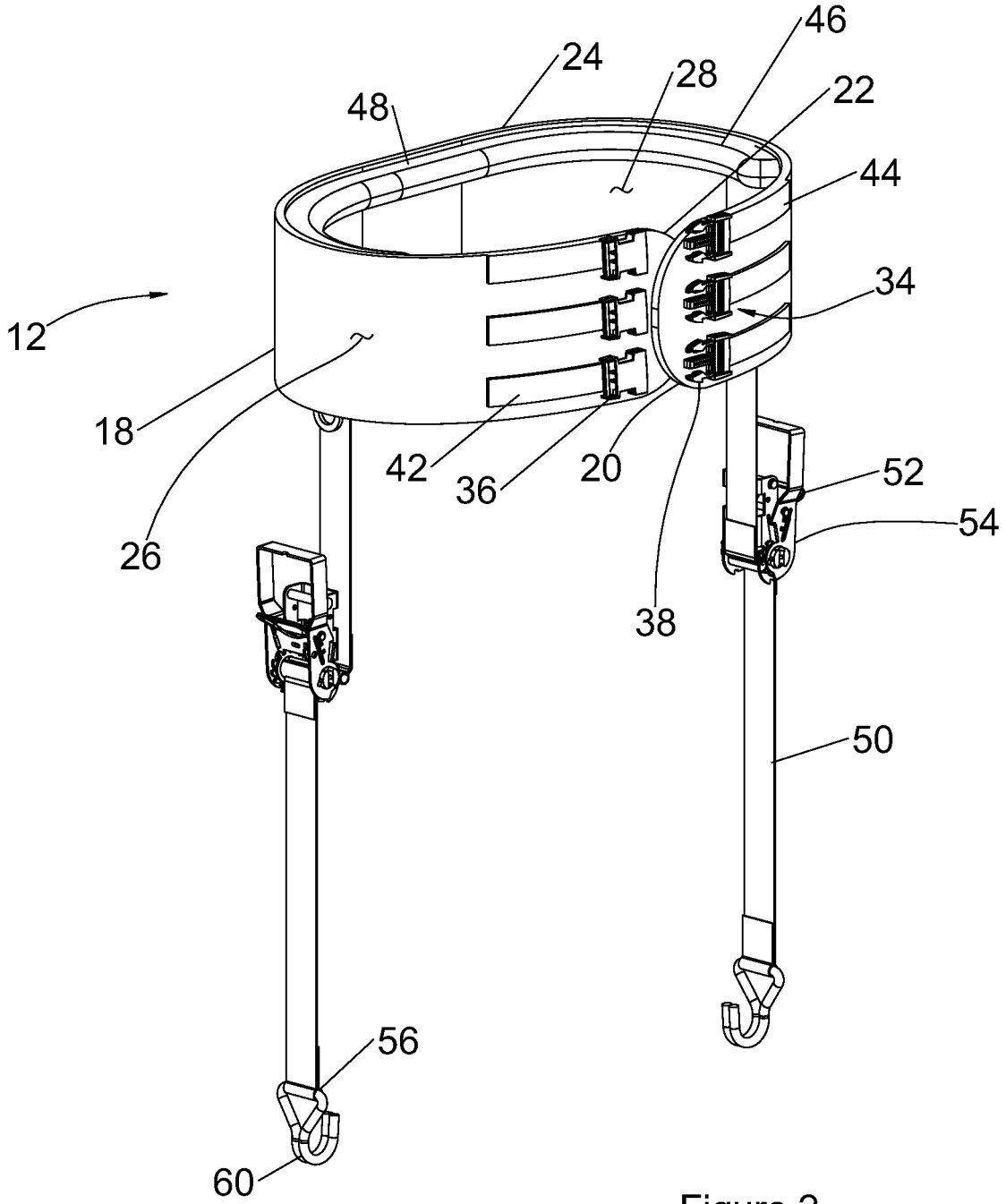
FIG. 2 is an illustrative example of the lumbar belt for use in the standing adjustment lumbar system illustrated in FIGS. 1A-1G.
Figure 3:
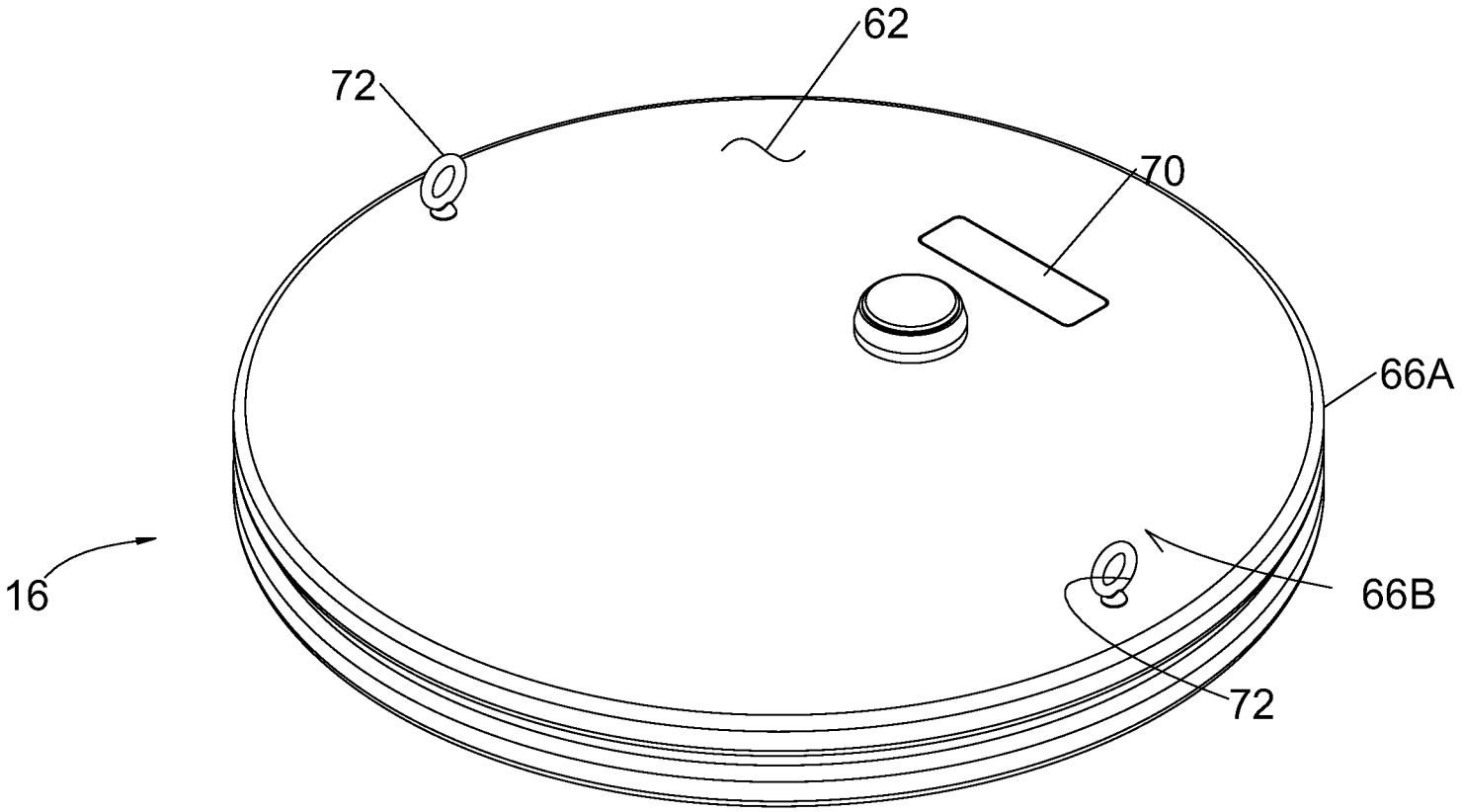
FIG. 3 is a perspective view of an illustrative example of a platform member for use in the standing adjustment lumbar system illustrated in FIG. 1A.
Figure 4:
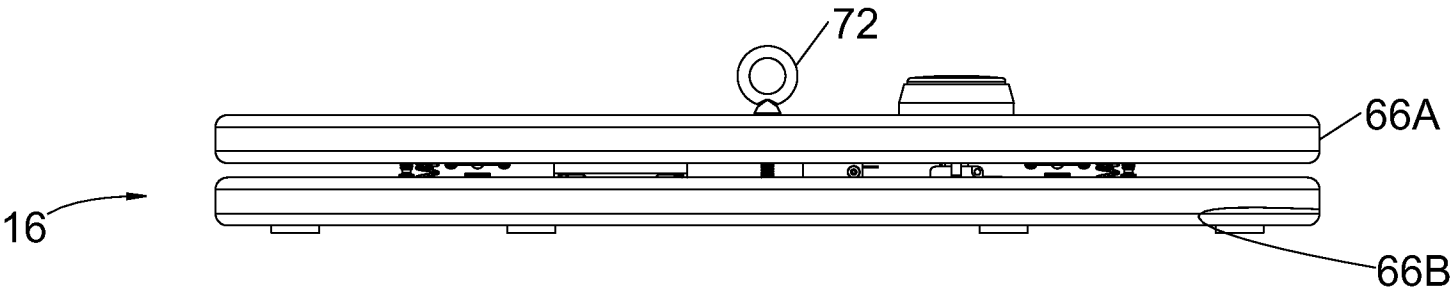
FIG. 4 is a side perspective view of the platform member illustrated in FIG. 3.

The standing adjustment lumbar system 10 utilizes the adjustable tension member 14 as a mechanism to provide tension. The adjustable tension member 14 includes a strap 50 and an adjustable tension generator 52. The strap 50 is secured to the main body 24 of the lumbar support belt 18 via stitching. An illustrative embodiment of the tension generator is shown as a tie down ratchet 54. An illustrative example of a tie down ratchet device is taught in U.S. Pat. No. 6,195,848 or U.S. Pat. No. 8,157,245. Preferably, there are adjustable tension members 14 on each side of the lumbar support belt 18. However, additional adjustable tension members 14 may be used if needed. The tie down ratchet 54 provides a mechanism to ratchet tension incrementally to the strap 50 when attached to the platform member 16. As shown in FIG. 2, the strap 50 contains a tube shaped channel 56 at and through the end of the strap 50. To attach to the platform 16, a securing member, illustrated as a J-hook 60, may be used. Alternatively, the strap 50 may contain other attachment mechanisms, such as a D-ring, O-ring, or a snap hook carabiner.

FIGS. 3-6 illustrate an example of the platform member 16. The platform member 16 is designed to support a user when he/she is using the standing adjustment lumbar system 10. The platform member 16 comprises an upper surface 62 and a bottom surface 64. The upper surface 62 is sufficiently sized to allow a user to comfortably place both feet thereon; the bottom surface 64 generally being in direct contact with the ground when in use. An upper platform main body 66A and a lower platform main body 66B separate the upper surface 62 and the bottom surface 64. The upper platform main body 66A and the lower platform main body 66B are shown having a round shape; however, such shape is not limiting and can be other shapes, such as a square. In an illustrative embodiment, the platform main body 16 is at least 24 inches across. A weight or tension measuring unit, to be described later, preferably with a digital viewing window 70 may be used to easily indicate to the user the amount of tension being applied during use (i.e. quantify the pull from the tension mechanism). To secure the adjustable tension members 14, preferably strap 50, thereto, one or more screw eyes (or eye bolts) 72 may be secured to the upper platform main body 66A and extend upwardly from the upper surface 62. Preferably, the weight or tension measuring unit has the capability to tare (start from zero when standing and measure forces at that point once applied).

Figure 5A:
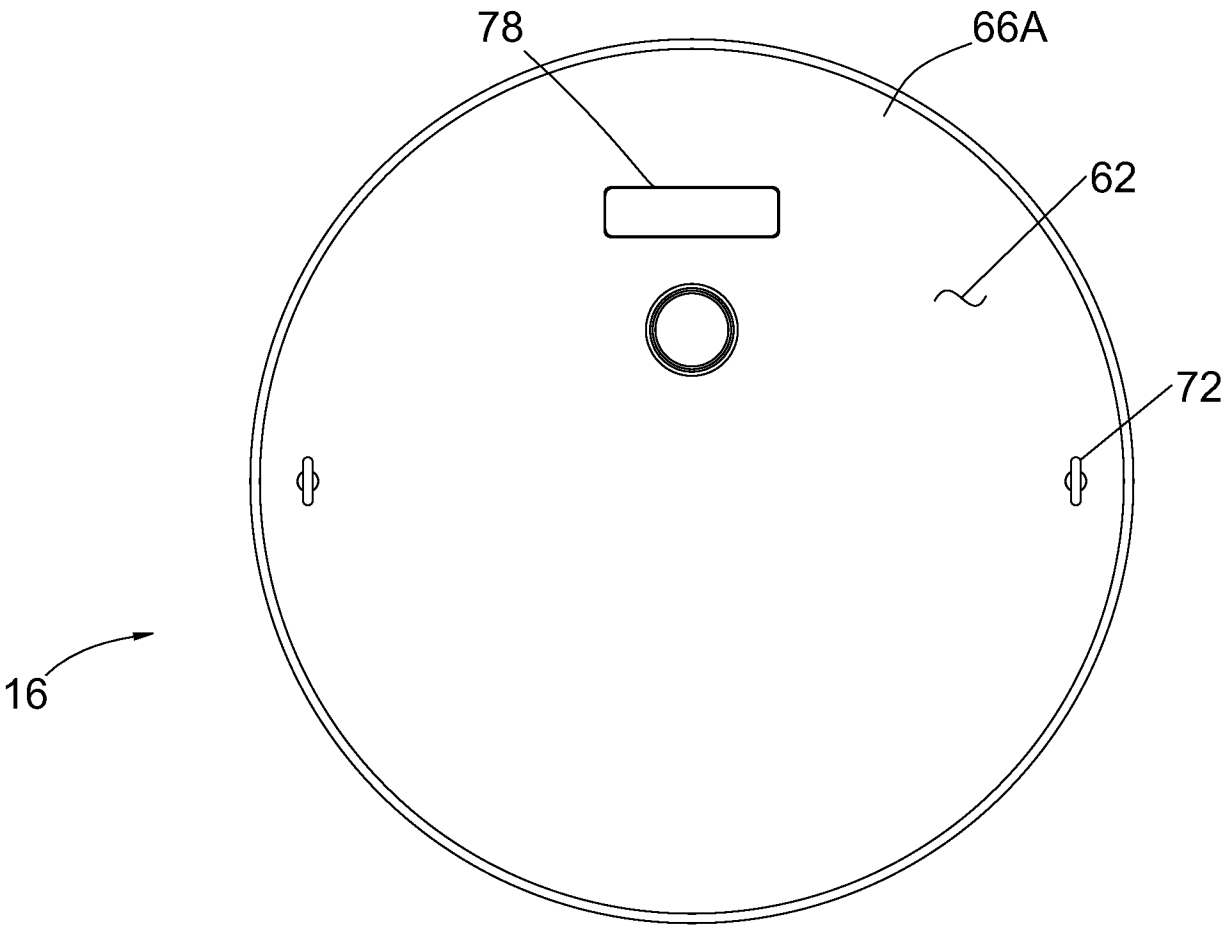
FIG. 5A is a top view of the platform member illustrated in FIG. 3.
Figure 5B:
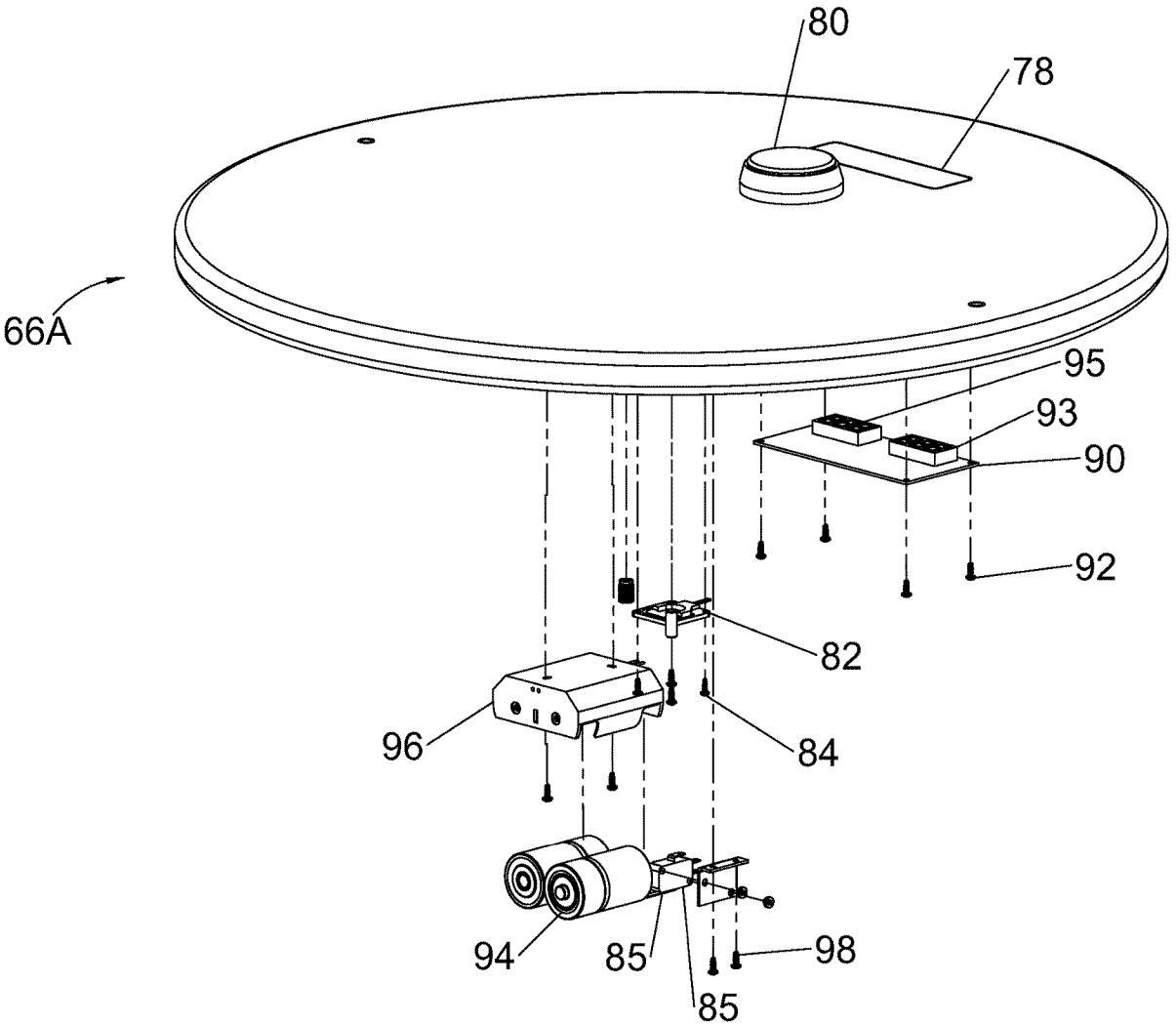
FIG. 5B is a partial exploded view of the platform member illustrated in FIG. 3 showing several functioning components.
Figure 5C:
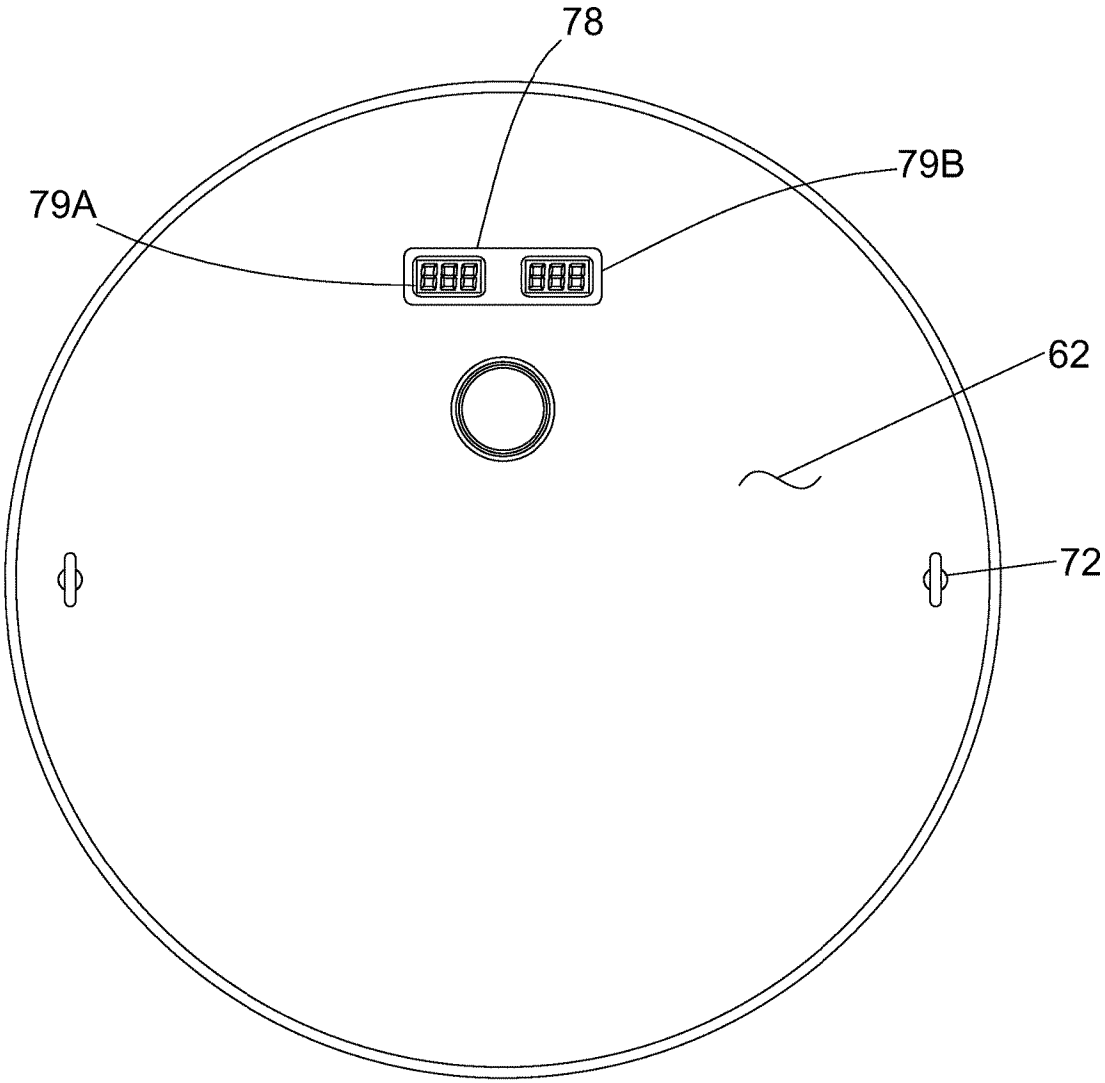
FIG. 5C is a top view of the platform member illustrated in FIG. 3, shown with a multiple segment LED display showing weight and time.
Figure 6:
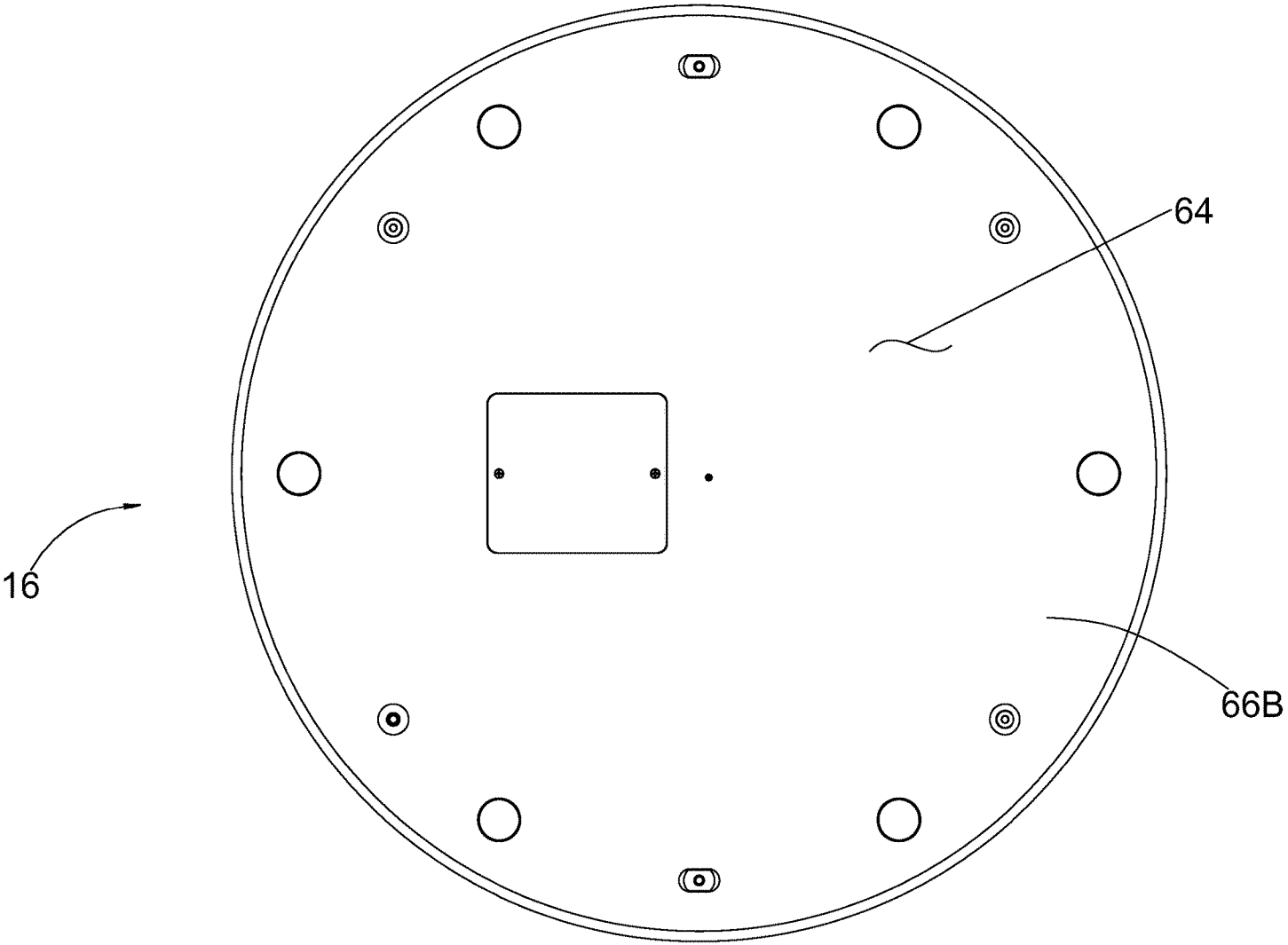
FIG. 6 is a bottom perspective view of the platform member illustrated in FIG. 3.
Figure 7A:
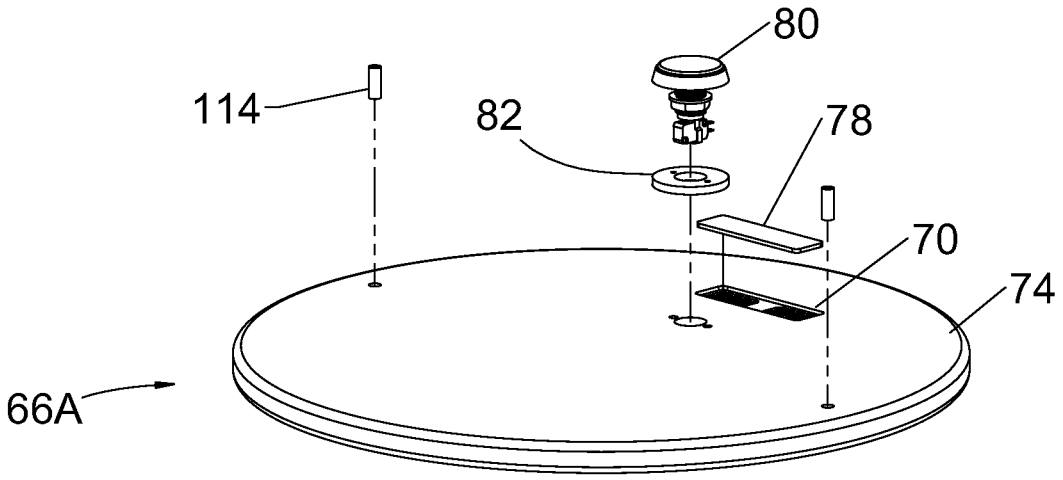
FIG. 7A illustrates an embodiment of the outer base portion of the upper platform main body.
Figure 7B:
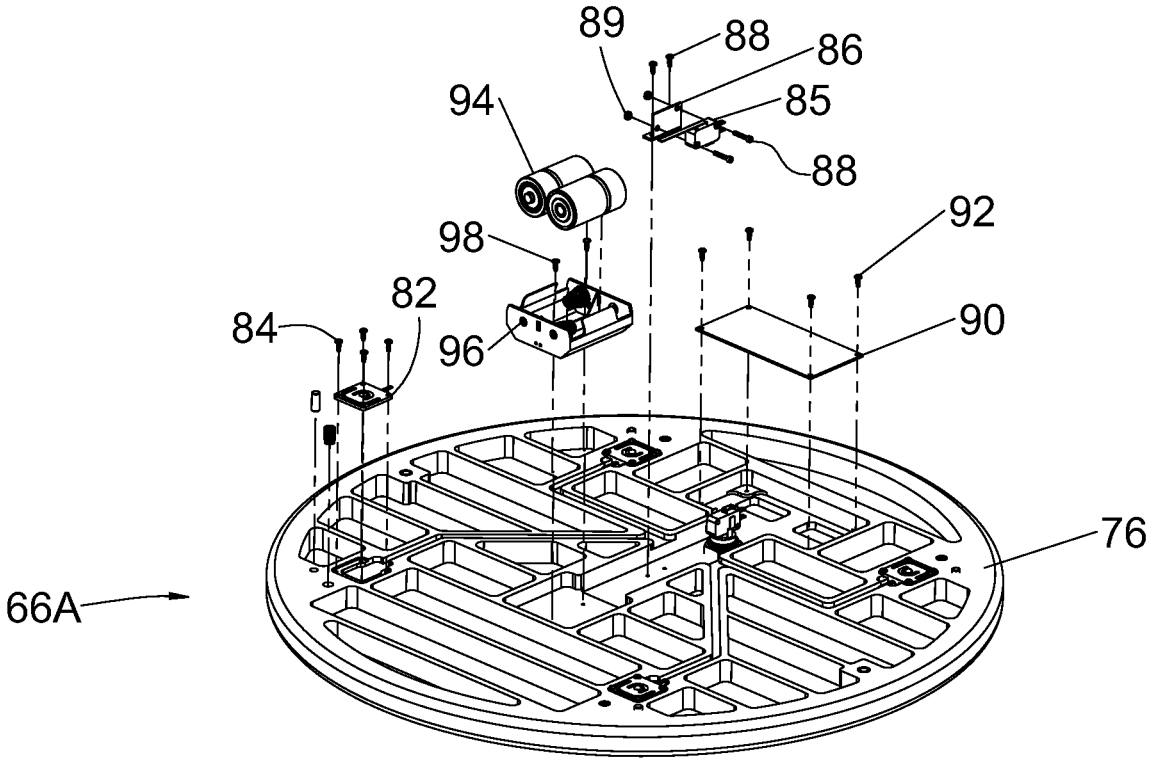
FIG. 7B illustrates an embodiment of the inner base portion of the upper platform main body.

Referring to FIGS. 7A and 7B, the outer base portion 74 of the upper platform main body 66A (FIG. 7A) and the inner base portion 76 of the upper platform main body 66A (FIG. 7B) is shown. The outer surface 74 may contain a lens cover 78, which forms part of the digital viewing window 70, a button 80 and a button standoff 82. In use, when a user presses the button 80, the user's weight is tared. This is usually performed after the user is standing on the device without engagement of the adjustable tension member(s) 14. When the button 80 is activated, i.e. pressed again, weight is again tared. Referring to FIG. 7B, a load sensor 82 is secured to the inner surface 76 via screws 84. The load sensor 82 is designed to measure the weight applied to the platform member 16, thus forming the weight and tension measuring unit described above. In use, the load sensor 82 senses the weight of the user plus the weight of the tension due to the tie down ratchet 54. Button 80 can be used to electronically tare, or zero the weight, typically after the user stands on the platform 16. The user can then apply tension via the tie down ratchet 54, and the additional weight would be displayed. A microswitch (snap action switch) 85 with switch bracket 86 secures to the inner surface 76 via screws 88 and nuts 89. A PCB (printed circuit board) 90 secures to the inner surface 76 via screws 92. A timer 93, which may be part of the printed circuit board 90, see FIG. 5B, may be activated when the button 80 is first pressed and tared. Power for the functioning of one or more components of the platform member 16 may be provided by batteries 94 (illustrated as D-cell dry batteries), secured to the inner surface 76 via the battery holder, or bracket 96 and screws 98. As illustrated in FIG. 5C, the display unit 78 may be a 7-segment LED screen, with numbers illustrating weight display 79A and timer (seconds, minutes or hours) display 79B. The weight display may be aided by use of a weight indicator or signal conditioner 95 (see FIG. 5B) which may receive electrical signals from the load sensor 82 and convert it into a digital output, i.e. readable numbers.

Figure 8A:
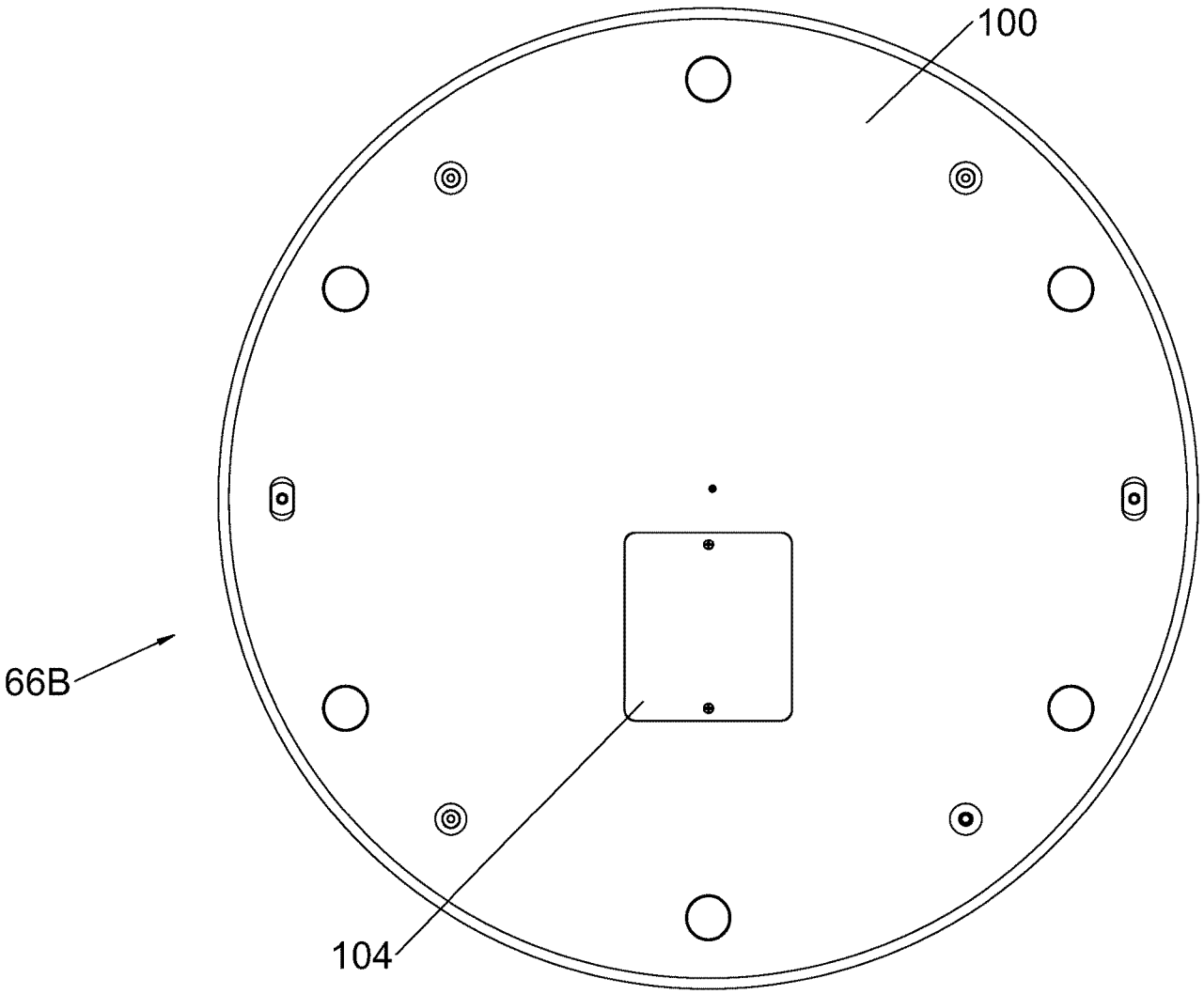
FIG. 8A illustrates an embodiment of the outer base portion of the lower platform main body.
Figure 8B:
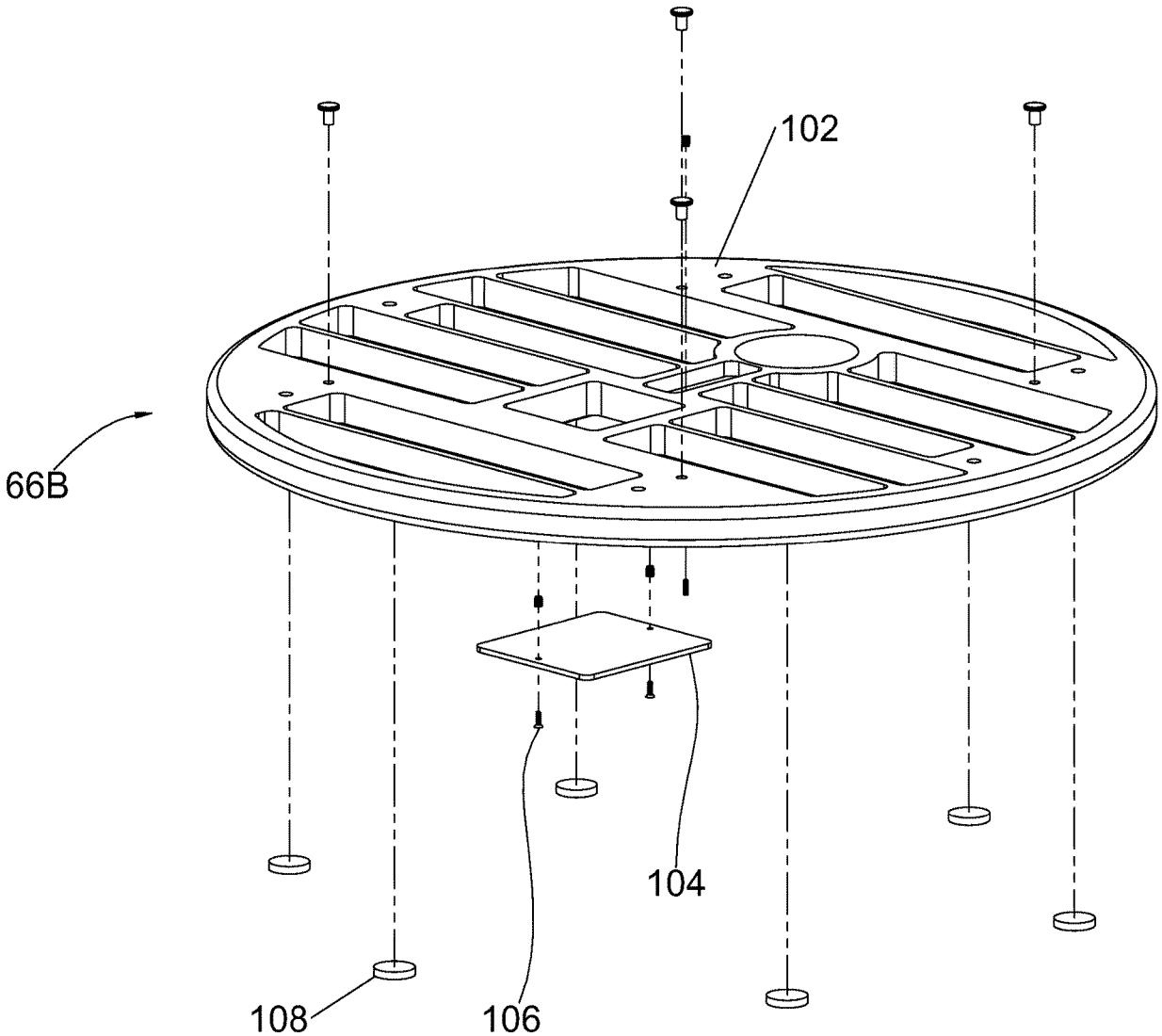
FIG. 8B illustrates an embodiment of the inner base portion of the lower platform main body.

Referring to FIGS. 8A and 8B, the outer base portion 100 (faces the ground when in use) of the lower platform main body 66B (FIG. 8A) and the inner base portion 102 (faces the upper platform main body 66A) of the lower platform main body 66B (FIG. 8B) are shown. Battery door 104 secures to the lower platform main body 66B via screws 106 and provides access to replace the batteries 94 when required. A plurality of adhesive-back feet 108 prevents the platform member 16 from unwanted sliding.

Figure 9:
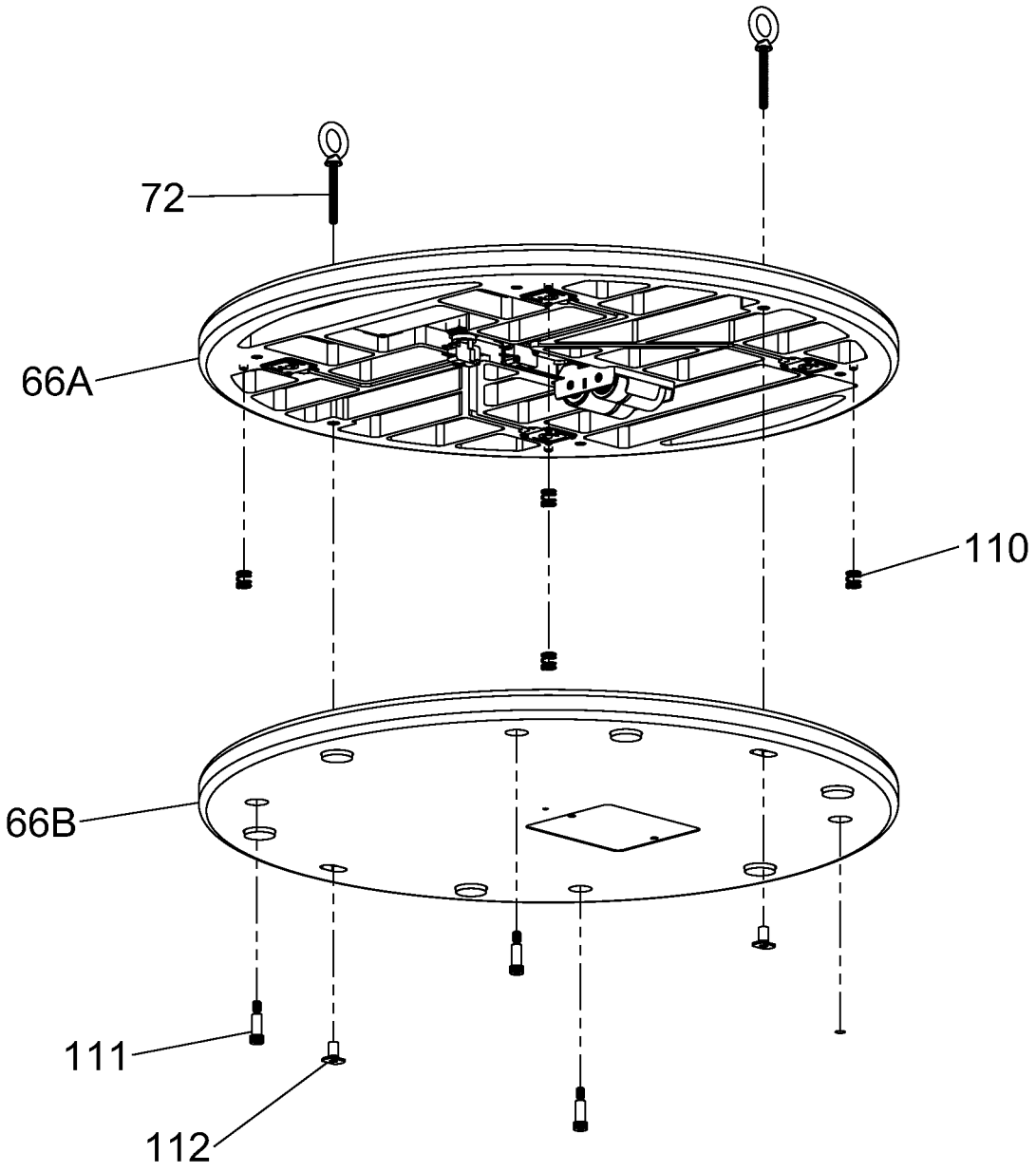
FIG. 9 is an exploded view of the platform member.

Referring to FIG. 9, compression springs 110 and shoulder screws 111 are used to prevent the upper platform main body 66A from touching the microswitch 85 until a user stands on the platform member 16. Screw eyes (or eye bolts) 72 with weld nuts 112 are fixed to the lower platform main body 66B and are free to slide through the upper platform main body 66A via sleeve bearings 114 (see FIG. 7A).

The standing adjustment lumbar system 10 is preferably used for people with low back pain (LBP). In such use, prolonged isometric contraction of the lumbar muscles will cause post isometric relaxation, thus causing tight and painful lumbar muscles to release and relax, reducing pain. While the primary use for the standing adjustment lumbar system 10 is preferably for treating people with low back pain (LBP), other uses are contemplated, including neuromuscular re-education. For such treatment, the standing adjustment lumbar system 10 could be used for neurologic patients attempting to regain neuromuscular control of the lower extremities; an example would be a person recovering from a stroke trying to regain proper motor control around the knee joint. Alternatively, the standing adjustment lumbar system 10 can be utilized for balance and proprioception to assist in regaining balance and proprioception for people recovering from lower extremity injuries or surgeries, such as post-surgical knee patients, ankle sprains, etc.

Figure 10:
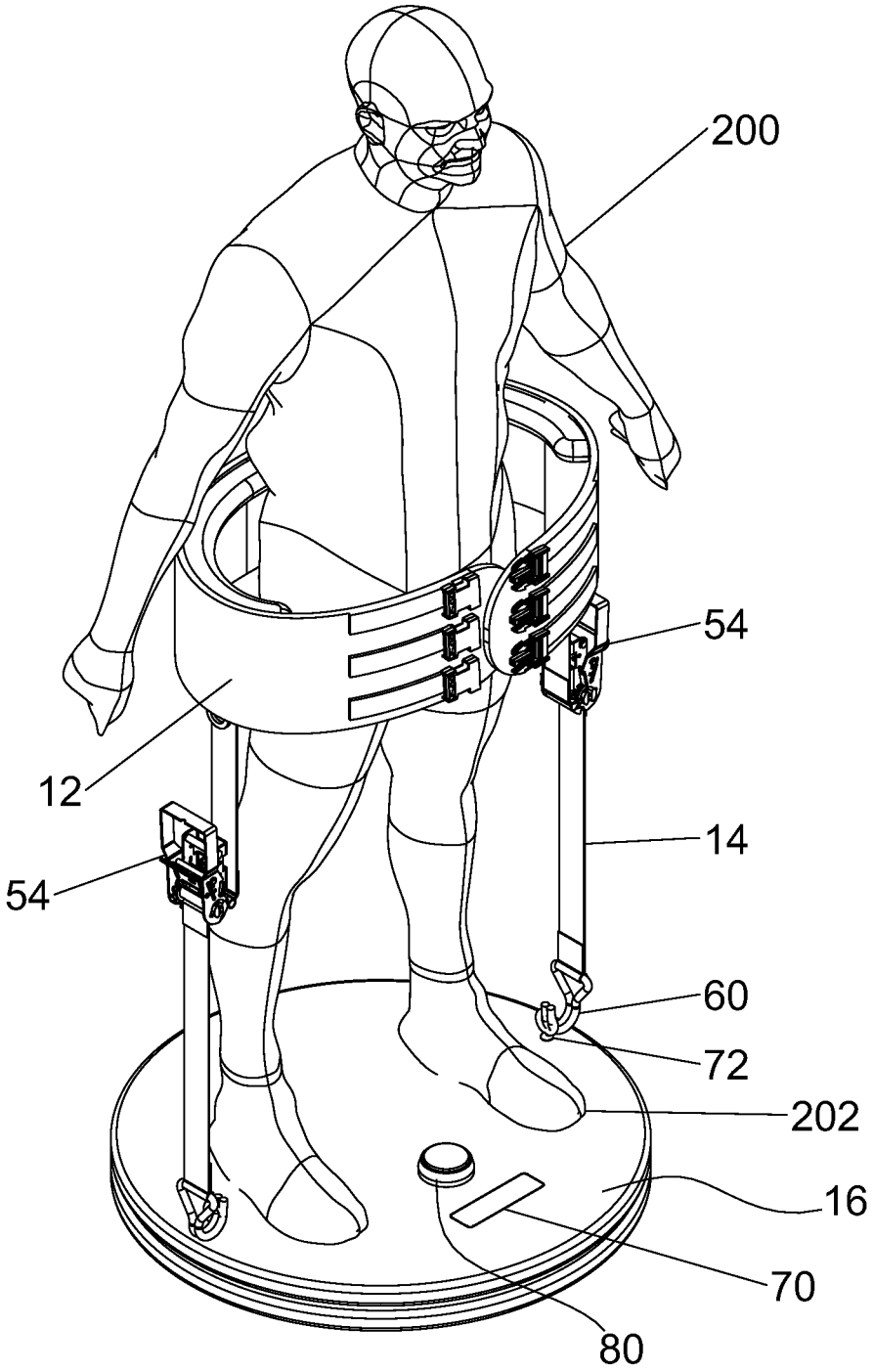
FIG. 10 illustrates the standing adjustment lumbar system in use, secured to a person.

FIG. 10 illustrates the standing adjustment lumbar system 10 in use. The standing adjustment lumbar system 10 is secured to a person 200 whose feet 202 are positioned on the upper surface 62 of the platform member 16. Any slack placed on the straps should be taken up, and the tension mechanism is ratcheted to a desired point of comfort or predetermined value. This position is preferably held for a predetermined time period, then released for a time period. The steps are then repeated as required. For example, a 200-lb. person may secure to the device and ratchet to 300 lbs. (150% of their body weight), holding for 2 minutes and releasing for 1 minute. This may be performed 3-4 additional times, or as desired.

In an illustrative example for use in low back pain (LBP), a user may:

1. Put the belt 18 on. The top of the belt 18 should be above the user's iliac crests;
2. Click the buckles 36/38 and pull to tighten the straps 50 as tight as comfortably possible;
3. Step onto platform member 16 with feet even and approximately shoulder width and knees slightly bent;
4. Release straps 50 from the tie downs 54, which are attached on the belt 18, and attach each strap to the eye rings 72 on the platform member 16.

Once on the platform member 16, the user's weight will be displayed, preferably on one of the two windows on the base.

The user will then:

5. 5. Tap the button 80 on the platform member 16 with his/her foot. Such action will tare the weight to zero on one window, and a timer will start simultaneously on the other;
6. Keeping knees slightly bent for safety, the user will start engaging, i.e. Cranking, the tie down ratchet 54 to a desired tension and for a desired time;
7. After using the system 10 for desired time and tension, the user will hit a release on the tie down ratchet 54;
8. The user will then rest for a desired time;
9. Steps 5-7 may be repeated as necessary.

All patents and publications mentioned in this specification are indicative of the levels of those skilled in the art to which the invention pertains.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A standing adjustment lumbar system comprising:

a lumbar support member sized and shaped to fit around a user's waist;

a first adjustable tension member secured to a first portion of said lumbar support member and configured to provide incremental tension adjustments;

a second adjustable tension member secured to a second portion of said lumbar support member and configured to provide incremental tension adjustments, said second portion of said lumbar support member being a different location than said first portion of said lumbar support member and wherein said second adjustable tension member is spaced apart from said first adjustable tension member;

a platform member comprising a surface of sufficient size to support a user in a standing position and a first adjustable tension member securing member configured to removably secure said first adjustable tension member thereto and a second adjustable tension member securing member configured to removably secure said second adjustable tension member thereto;

a weight or tension measuring unit configured to measure a weight or tension applied to said platform member, a tare button configured to zero said weight or tension applied to said platform member; and a digital display unit configured to display said weight or tension applied to said platform member.

2. The standing adjustment lumbar system according to claim 1, wherein said platform member comprises a timing mechanism.

3. The standing adjustment lumbar system according to claim 2, wherein said timing mechanism is configured to begin after a user's weight or tension applied thereto has been tared.

4. The standing adjustment lumbar system according to claim 2, wherein said platform member is configured to display said time of said timing mechanism.

5. The standing adjustment lumbar system according to claim 2, wherein said time of said timing mechanism is displayed in said display unit.

6. The standing adjustment lumbar system according to claim 1, wherein said lumber support member comprises a shaped material integrally formed or attached to an inner surface near a top portion of said lumber support member elongated main body.

7. The standing adjustment lumbar system according to claim 6, wherein said lumber support member shaped material is sized to run a sufficient length along the length of the lumbar support member so that, when said lumber support member is placed on a user, said lumber support member shaped material contacts or grabs hold of the user's iliac crest.

8. The standing adjustment lumbar system according to claim 1, wherein said platform member comprises an upper platform main body and a lower platform main body.

9. The standing adjustment lumbar system according to claim 8, wherein said upper platform member and said lower platform member are separated by one or more springs.

10. The standing adjustment lumbar system according to claim 1, wherein said lumber support member includes a support belt sized and shaped to secure about at least a portion of a person, said support belt having a first end, a second opposing end, and an elongated main body therebetween.

11. The standing adjustment lumbar system according to claim 1, wherein said lumber support member is made of a cloth material.

12. The standing adjustment lumbar system according to claim 1, wherein said lumber support member is made of a non-slip material.

13. The standing adjustment lumbar system according to claim 1, wherein said lumber support member comprises at least one fastening member configured to secure together said first end and said second end.

14. The standing adjustment lumbar system according to claim 1, wherein said first tension member includes a strap and an adjustable tension generator, and said second tension member includes a strap and an adjustable tension generator.

15. A method of relieving pain associated with one or more conditions comprising:

causing at least one round of isometric contraction followed by relaxation of one or more muscles to an individual in need thereof, by providing a standing adjustment lumbar system, said standing adjustment lumbar system comprising:

a lumbar support member sized and shaped to fit around a user's waist, a first adjustable tension member secured to a first portion of said lumbar support member and configured to provide incremental tension adjustments, a second adjustable tension member secured to a second portion of said lumbar support member and configured to provide incremental tension adjustments, said second portion of said lumbar support member being a different location than said first portion of said lumbar support member and wherein said second adjustable tension member is spaced apart from said first adjustable tension member, a platform member comprising a surface of sufficient size to support a user in a standing position and a first adjustable tension member securing member configured to removably secure said first adjustable tension member thereto and a second adjustable tension member securing member configured to removably secure said second adjustable tension member thereto, a weight or tension measuring unit configured to measure a weight or tension applied to said platform member, a tare button configured to zero weight or tension applied to said platform member, and a digital display unit configured to display said weight or tension applied to said platform member;

wherein, said user securing said lumbar support member to said user's waist;

while standing on said platform member, obtaining a weight or tension value of said user, said weight or tension value;

taring said weight or tension value to a zero value;

adjusting tension of said first adjustable tension member, said second adjustable tension member, or said first adjustable tension member and said second tension member to obtain a desired post tared weight or tension value; and after a predetermined time period, releasing said tension applied by said first adjustable tension member or said second member.

16. The method of relieving pain associated with one or more conditions according to claim 15 wherein said standing adjustment lumbar system further includes a timer, wherein an amount of time associated with said predetermined time period is displayed on said platform member.

17. The method of relieving pain associated with one or more conditions according to claim 16, further including the steps of:

adjusting tension of said first adjustable tension member, said second adjustable tension member, or said first adjustable tension member and said second tension member to obtain a desired post tared weight or tension value for at least a second time; and after a predetermined time period for at least a second time, releasing said tension applied by said first adjustable tension member or said second adjustable tension member.

18. The method of relieving pain associated with one or more conditions according to claim 16, wherein said predetermined time period is displayed on said display unit.

19. The method of relieving pain associated with one or more conditions according to claim 16, wherein said timer starts simultaneously upon taring the weight to zero.

20. The method of relieving pain associated with one or more conditions according to claim 15, where said muscles are lumbar muscles.

* * * * *